United States Patent [19]

DiRico

[11] Patent Number: 4,522,016

[45] Date of Patent: Jun. 11, 1985

[54] CARTON SUPPORT AND ERECTION MACHINE

[76] Inventor: Mark A. DiRico, 416 Adams St., Quincy, Mass. 02169

[21] Appl. No.: 537,987

[22] Filed: Sep. 30, 1983

[51] Int. Cl.[3] ..... B65B 43/26

[52] U.S. Cl. ..... 53/564; 53/374; 53/390

[58] Field of Search ..... 53/390, 374, 564, 458, 53/491

[56] References Cited

U.S. PATENT DOCUMENTS

| | | | |
|---|---|---|---|
| 2,057,284 | 10/1936 | Walker | 53/390 |
| 2,075,833 | 4/1937 | Smith | 53/390 |
| 3,039,370 | 6/1962 | Van Houden King, Jr. | 53/374 X |
| 3,146,567 | 9/1964 | Filipek | 53/390 |
| 4,179,866 | 12/1979 | Graham et al. | 53/374 X |

*Primary Examiner*—Horace M. Culver

[57] ABSTRACT

A shipping carton erecting and holding device comprising: a support structure for supporting a carton in an upright position during loading; and a discharge means for discharging a filled carton from the device which includes a U-shaped engaging member to engage one end of, and to extend at least partially around the sides of, a carton, and a pair of horizontal spaced-apart rails, positioned entirely between the side walls of the device and entirely forward of the rear wall; a drive means communicating with the U-shaped member to move it between a first position on the rails in which the member is positioned to engage one end of a said carton supported on said support structure, and a second position spaced generally horizontally from said first position whereby movement of said member from said first position to said second position will move a said carton off of said support structure and discharge it, the drive means being mounted along one side wall, entirely forward of the rear wall of the device. A method of using a shipping carton and holding device with automatic sequencing features is also disclosed.

19 Claims, 7 Drawing Figures

CARTON SUPPORT AND ERECTION MACHINE

BACKGROUND OF THE INVENTION

This invention relates to devices for erecting cartons and for supporting cartons during packing.

Such devices should be compact and allow easy access to the carton during filling, particularly where manual filling is used. Moreover, the device should reliably fold the carton flaps to avoid costly delays. Finally, the device should reliably and quickly discharge the filled carton to a conveyor. While automation of these various functions on the device improves the speed and efficiency of carton erecting and loading, mechanisms which hinder access to the carton by loading personnel should be avoided.

Various approaches are known for erecting the cartons. For example in Lesek U.S. Pat. No. 4,063,492, the bottom side flaps are folded by rollers which engage those flaps from the bottom and roll along the flap while moving it upwardly into a horizontal position.

Tucker et al. U.S. Pat. No. 3,358,567 (which is hereby incorporated by reference) discloses a mechanism that includes swinging doors to fold the carton flaps. Kemp U.S. Pat. No. 3,591,553 shows two "folding arms" located respectively on opposite sides of a conveyor which move inwardly to fold opposed flaps of a blank for a box or carton.

Various approaches are known for moving the loaded carton from its support. Lesek (cited above) and Mancini, U.S. Pat. No. 3,967,434 disclose a carton push bar which is driven by a centrally located piston to discharge the carton from its loading support.

Various patents [Anderson U.S. Pat. No. 3,971,467, Nigrelli U.S. Pat. No. 2,997,833, and Mancini U.S. Pat. No. 3,967,434] disclose systems in which a drive moves boxes along a path.

Finally it is known to tilt the box or carton during filling [See, e.g., Rouse U.S. Pat. No. 3,229,444, Morano U.S. Pat. No. 3,269,083, and Staley U.S. Pat. No. 3,585,782].

The above-described systems offer less than optimal performance with respect to compactness, overall reliability and to the efficiency and interrelationship of the flap-folding and discharge mechanisms.

SUMMARY OF THE INVENTION

The invention features, in one aspect, a shipping carton erecting and holding device comprising: a support structure for supporting a carton in an upright position during loading; and a discharge means for discharging a filled carton from the device which includes a U-shaped engaging member to engage one end of, and to extend at least partially around the sides of, a carton, and a pair of horizontal spaced-apart rails, positioned entirely between the outer side walls of the device and entirely forward of the outer rear wall; a drive means communicating with the U-shaped member to move it between a first position on the rails in which the carton is supported by the device and the member is positioned to engage an end of the carton, and a second position on the rails generally horizontally spaced from the first position whereby movement of the member from the first position to the second position will move the carton off of the support structure and discharge it, the drive means being mounted along one side wall, entirely forward of the rear wall of the device.

In a second aspect, the invention features an erecting and holding device for a shipping carton having a pair of bottom end flaps and a pair of bottom side flaps, comprising: a support structure for supporting a carton in an upright position with the bottom end flaps folded into a generally horizontal position and the side flaps unfolded and extending generally vertically downwardly; a pair of folding members, mounted below and on opposite sides of the support structure, each comprising a surface attached to a first drive means, which is adapted to swing the folding-member surfaces from a vertical position to a substantially horizontal position; and a tilt means for moving the support structure between a first position in which the carton is substantially horizontal and a second position in which the carton is inclined with respect to the horizontal, and for supporting the structure in the inclined position; the tilt means comprises a member, connecting the support structure to a horizontal member, hinged at a point which is connected to a reciprocating piston rod, whereby movement of the rod flexes said hinge, altering the effective length of the connecting member to change the height of said support structure in the vertical plane through the point of connection between the support structure and the member; a discharge means as described above; and control means for activating the drive means and the tilt means.

In a third aspect the invention features automatic sequencing in a method of erecting and filling a carton comprising: providing a carton having its bottom end flaps folded horizontally, and its bottom side flaps in an unfolded vertical position; providing an apparatus comprising a support structure and a mechanical means to fold the bottom side flaps into a horizontal position, mechanical means for tilting the carton between a horizontal position and a position inclined to the horizontal and supporting the carton in the inclined position, and mechanical means for discharging the carton from said frame; placing the carton on the apparatus, activating the mechanical folding means, and activating the mechanical tilting means to tilt the carton to the inclined position; thereafter filling the carton and activating the tilt means to level the full carton, whereby the mechanical discharge means is automatically activated and reset and both the mechanical folding means and the mechanical tilting means are automatically reset.

In preferred embodiments, the above-described automatic sequencing is performed by a series of switch means which: activate the first drive means to move said folding-member surfaces from a vertical position to a horizontal position; activate the tilt means to move the support structure from the inclined position to the horizontal position; automatically activate the discharge means to move the U-shaped member from the first position to the second position when the support structure reaches the horizontal position; automatically activate the second drive means to move the U-shaped member from the second position to the first position when the U-shaped member reaches the second position; automatically activate the first drive means to move the flap-folding surfaces from the horizontal position to the vertical position when the U-shaped member returns to the first position; and automatically activate the tilt means to move the support structure from the horizontal position to the inclined position when the U-shaped member returns to the first position.

The resulting apparatus is fast, reliable and efficient. Specifically, it is compact and enables the operator to gain access to the carton easily, thereby reducing the physical strain on and the chance for error by the operator.

DESCRIPTION OF THE PREFERRED EMBODIMENT

I first briefly describe the drawings.

Drawings

STRUCTURE

Figure 1:
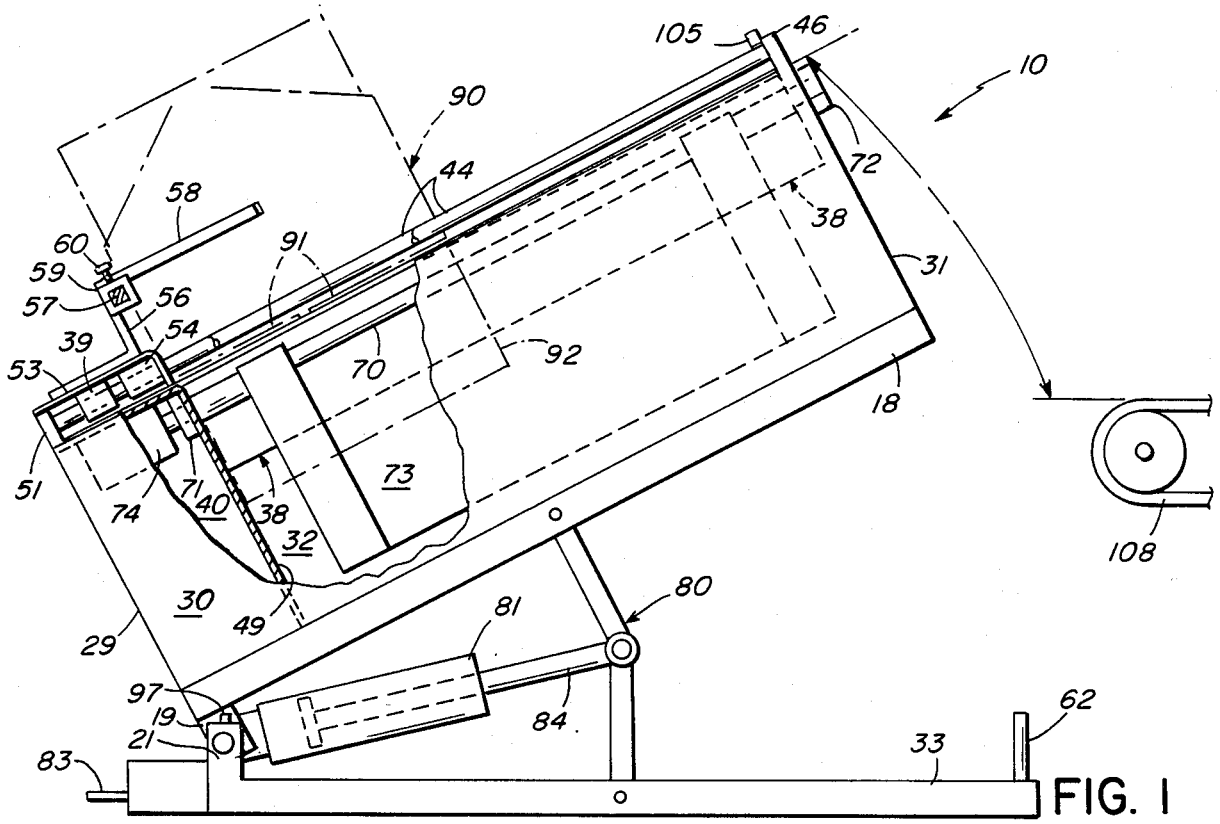
FIG. 1 is a side view of a carton-erecting and filling apparatus with parts broken away, and a carton shown in phantom.
Figure 3:
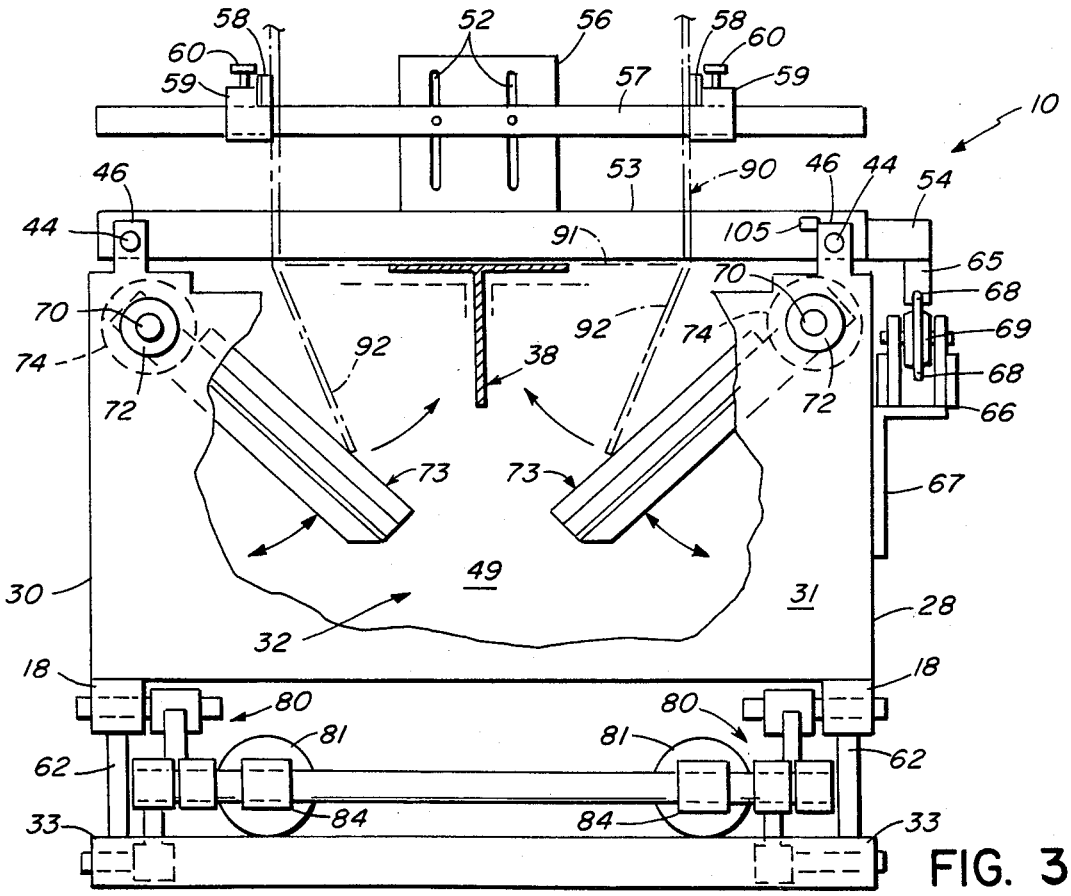
FIG. 3 is a front view of the apparatus of FIG. 1, with parts broken away and in section.

In FIGS. 1–5, a carton-folding apparatus is generally designated as 10. The apparatus has vertical outer side walls 28 and 30, and vertical end walls 29 (rear) and 31 (front), constructed from 16 guage steel and welded together to form a rectangular enclosure having a central cavity 32. Walls 28 and 30 are each supported by a lateral steel rail 18 extending along the bottom of each wall. Each rail 18 at its rear terminus bends 90° inward along the bottom of rear endwall 29 and then 90° downward to form a segment 19 which is pivotally attached to vertical extensions 21 of bottom rectangular support frame 33.

Device 10 includes a side-flap folding mechanism within cavity 32. Specifically, at the rear of the top of enclosure is a horizontal shelf 48 spanning between side walls 28 and 30 and extending along rear wall 29. A vertical wall 49 extends downwardly from the front end of shelf 48, so that wall 49, wall 29 and shelf 48 define an enclosure 40 in the rear of cavity 32. A horizontal support 38 extends longitudinally in the center of the top of cavity 32 from wall 49 to wall 31.

Each of two horizontal support bars 70 is parallel to and spaced inwardly from a side wall. Each support bar 70 extends from its rear mounting bearing 71 in wall 49 to its forward mounting bearing 72 in front wall 31. A flap-folding door 73 is attached along one of its longitudinal edges to each bar 70. Each support bar 70 extends through wall 49 to a pneumatic rotary cylinder 74 mounted in enclosure 40. For example, a suitable rotary cylinder is model CRB50-100 made by SMC Pneumatics, Inc., Indianapolis, Ind.

Apparatus 10 also includes a pneumatically driven tilting linkage comprising a hinged support 80 between each side of frame 33 and each side rail 18. A pneumatic cylinder 81 drives a piston rod 84 attached to each support 80 at its hinge.

Above the top of the enclosure formed by walls 28–31 is a push-bar support mechanism comprising an L-shaped metal shelf 53 which is attached to a hollow horizontal support rail 54 extending across the width of the cavity. A cylindrical guide rail 44 extends parallel to, above, and spaced inwardly from each of side walls 28 and 30. At the front end of the apparatus, each rail 44 is fixed to a bracket 46 on the top of front wall 31. The opposite end of each rail 44 is fixed to a bracket 51 on the top of rear wall 29. The vertical front wall of shelf 53 includes two openings positioned to accomodate each rail 44. Behind that front wall, each rail 44 extends through support rail 54 and through suitable bearings 39, attached under shelf 53.

The push bar mechanism comprises a right angle bracket 56 attached to the center of the horizontal surface of shelf 53. Horizontal push rod 57 is adjustably attached to the vertical face of bracket 56 by bolts in vertical grooves 52. A horizontal guide arm 58 is fixed to each of two square clamps 59 which are slidably attached to rod 57. A screw 60 through one face of each clamp 59 enables arms 58 to be fixed along rod 57, so that the distance between the guide arms can be adjusted.

Figure 4:
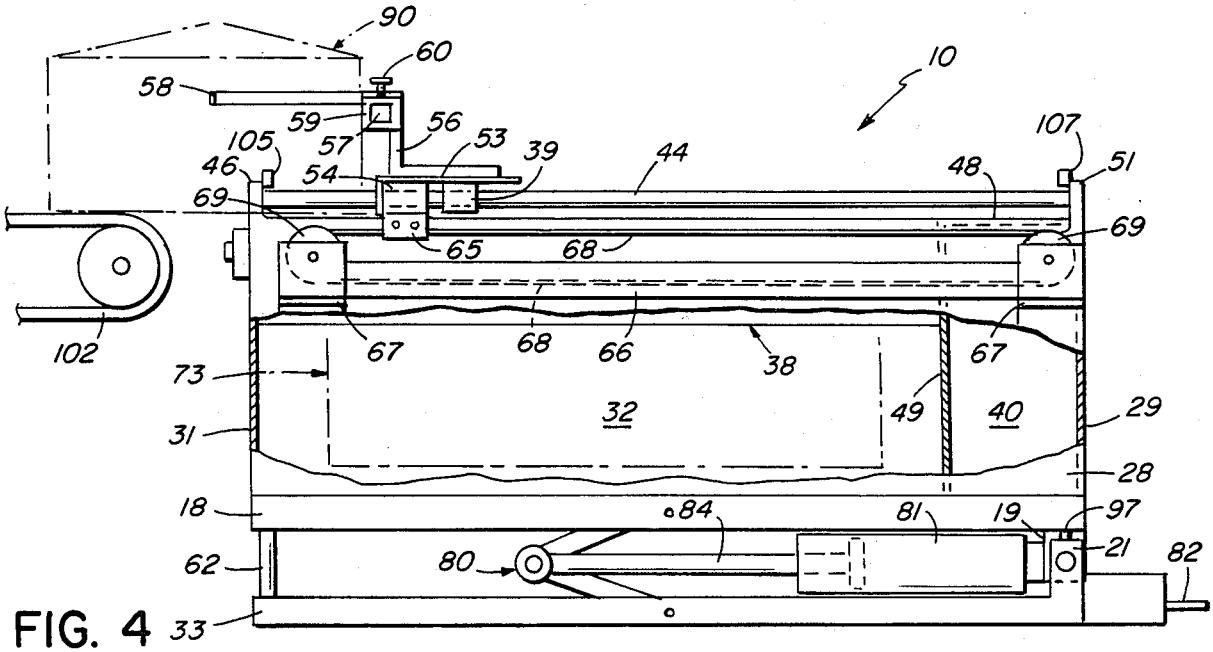
FIG. 4 is a side view of the apparatus of FIG. 1, showing an alternate frame position.
Figure 2:
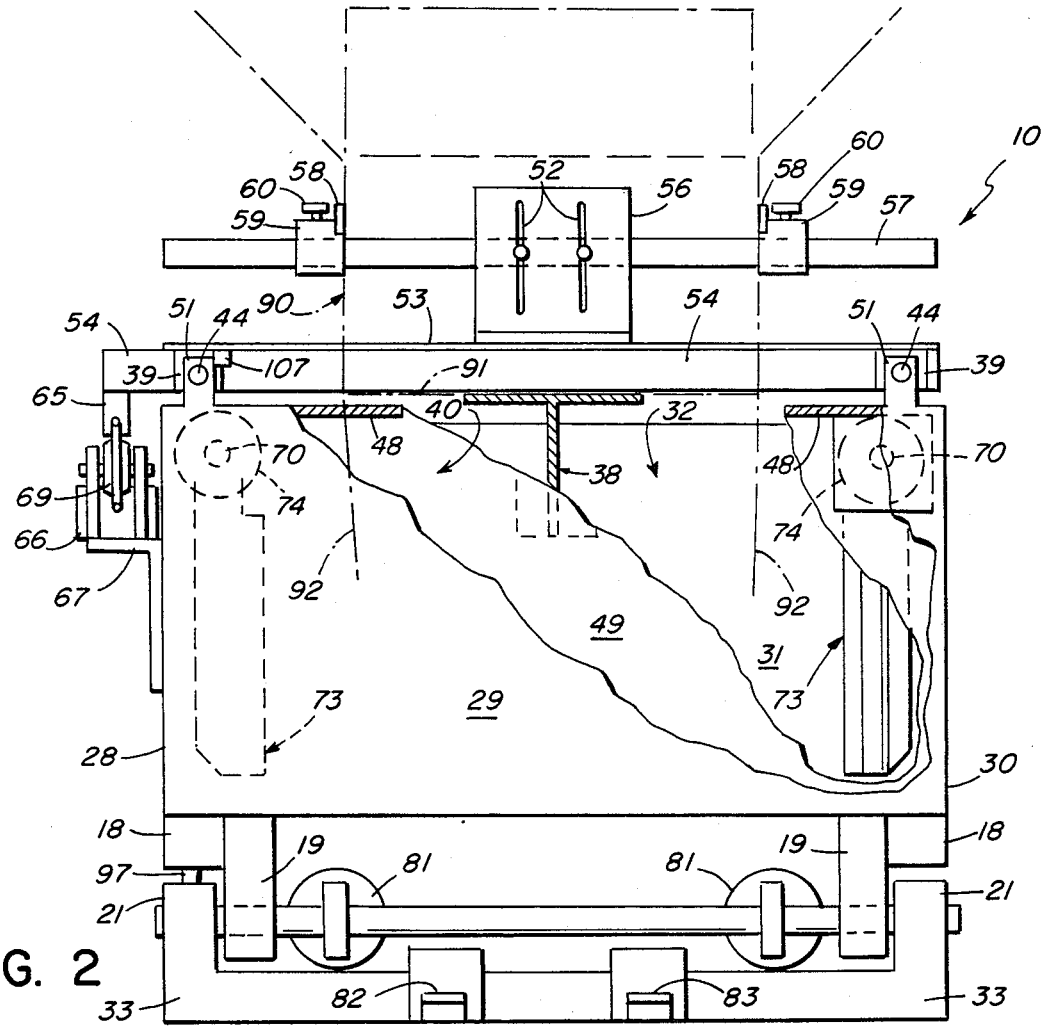
FIG. 2 is a rear view of the apparatus of FIG. 1, with parts broken away and in section.
Figure 5:
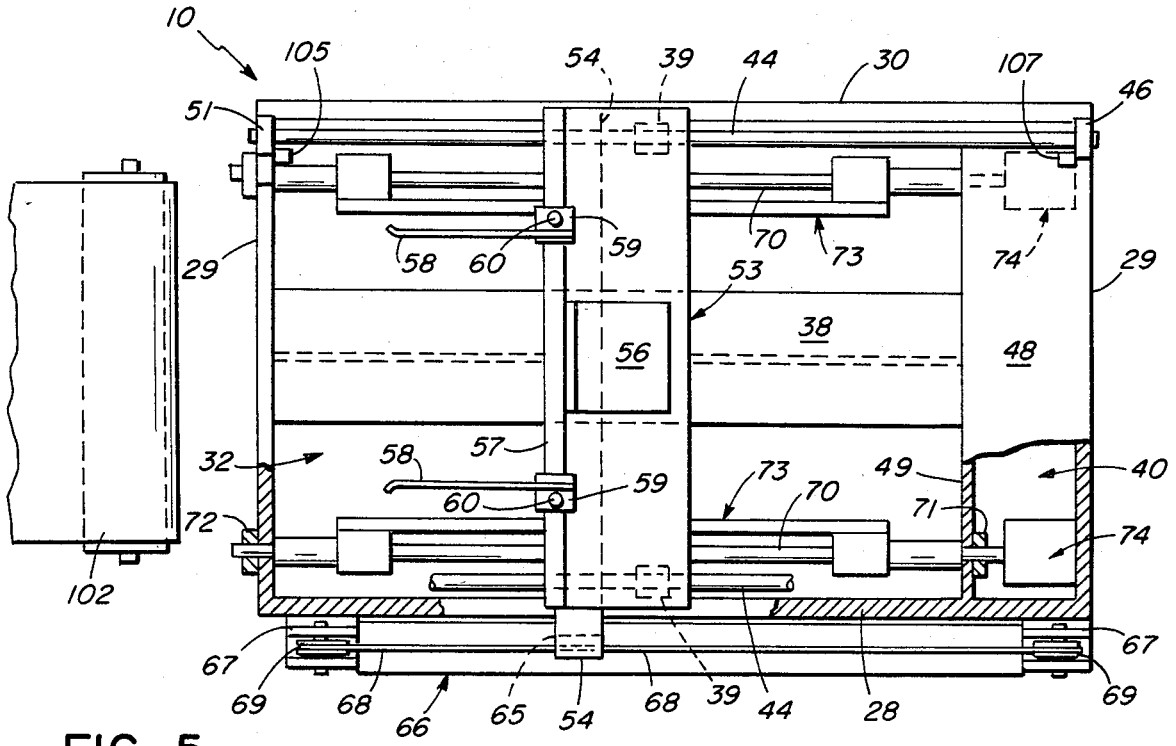
FIG. 5 is a top view of the apparatus of FIG. 1.
Figure 5A:
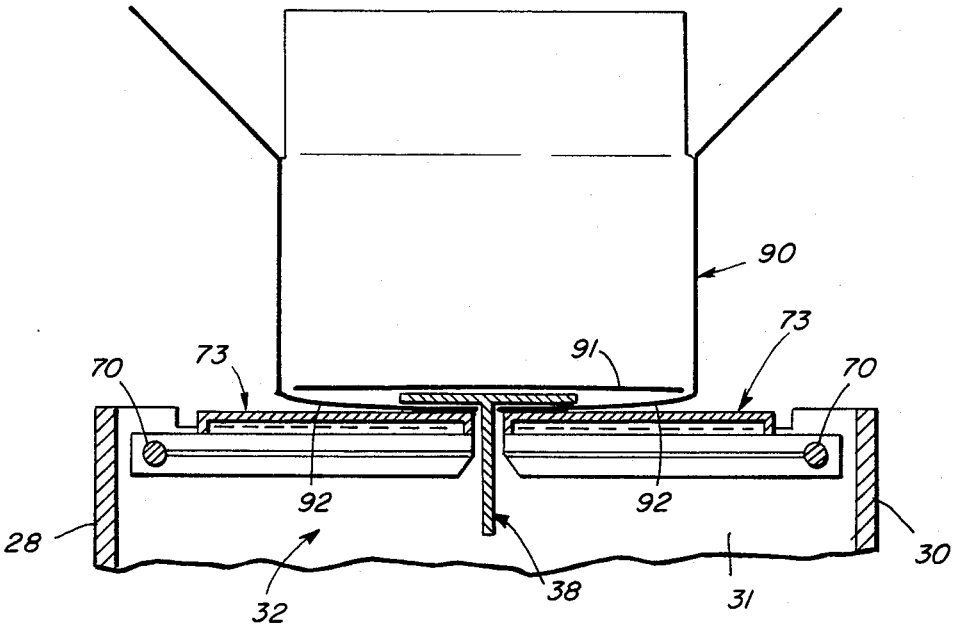
FIG. 5A is an enlarged front view of a portion of the apparatus, with parts broken away and in section.

The push-bar drive mechanism extends along one side of apparatus 10 (FIG. 4). Specifically, attached to the bottom of one end of support rail 54 is cable bracket 65 fixed to cable 68. Cable 68 extends horizontally along wall 28, around pulleys 69 attached respectively by brackets 67 to the front and rear of wall 28. Cable 68 is driven by a pneumatic cylinder 66 such the Tol-0-Matic's (Minneapolis, Minn.) 1½ inch cable cylinder.

Two footpedals 82 and 83 at the rear of apparatus 10 control the pneumatic cylinders as described below.

Operation

In the starting position of the carton erecting and filling apparatus, flap-folding doors 73 are positioned vertically downward, and rod 57 is at the rear of the apparatus. Cylinders 81 are positioned with rods 84 extended, causing the frame to be tilted with the front end up, to facilitate access to and loading of the carton 90.

An unfolded carton blank 90 is seated on the top of cavity 32 by folding bottom end flaps 91 inwardly and supporting the carton on the top of the central horizontal surface of support 38, with guide arms 58 adjusted to center the carton over support 38.

Figure 6:
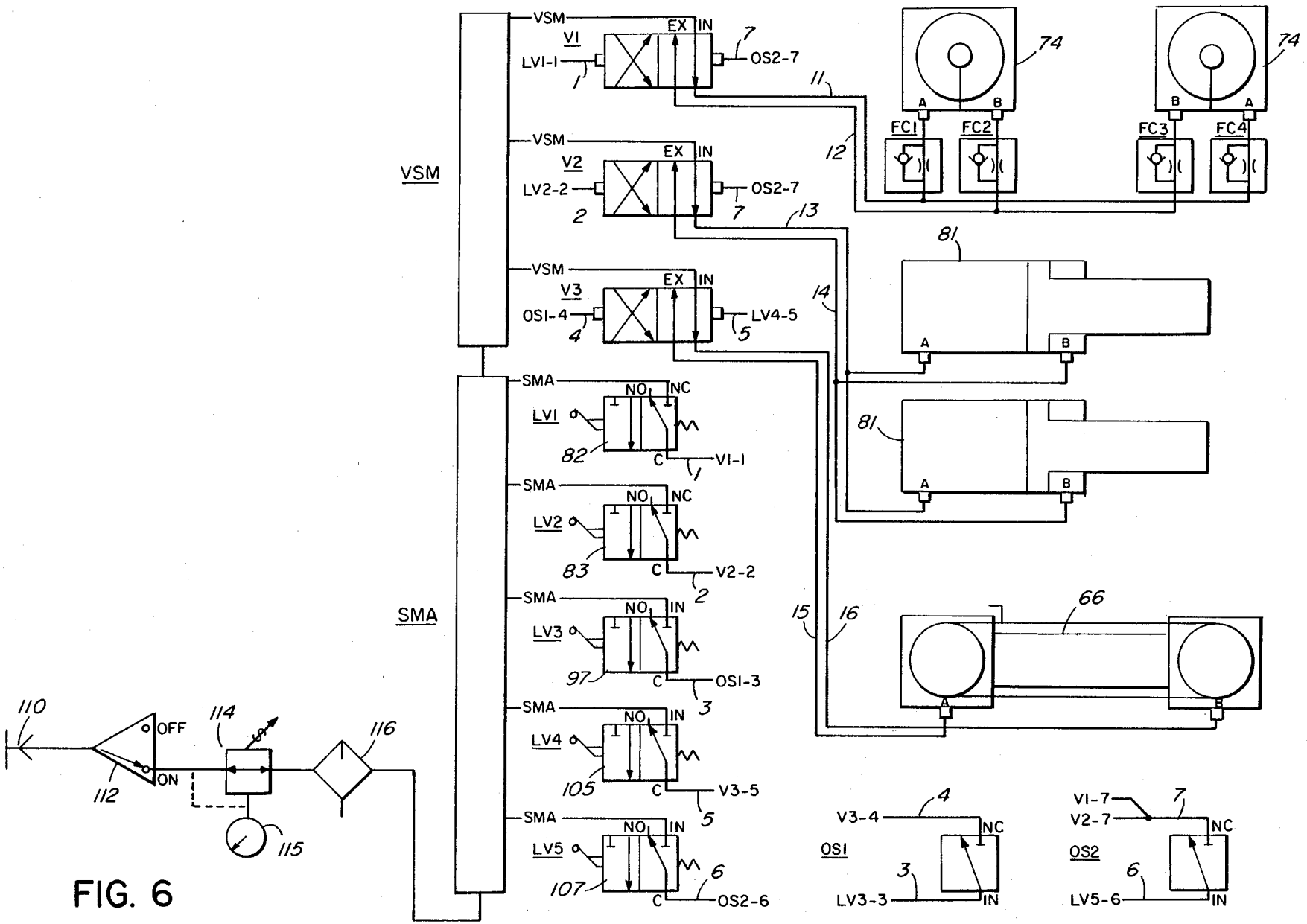
FIG. 6 is a schemmatic diagram of the air pressure system of the apparatus of FIG. 1.

FIG. 6 shows, schemmatically, the pneumatic system of apparatus 10. On FIG. 6, VSM refers to a valve system manifold for connecting various valves to an SMA (air supply manifold). The SMA is connected by a quick-disconnect connector 110 to a supply of pressurized air (not shown). Downstream from the connector 110 is a ball valve 112, a regulator 114 and guage 115, and an air lubricator 116, which is connected to the SMA. Various air limit valves LV1–LV5 are connected to the SMA as shown.

The operation of the pneumatic system is described below.

To fold bottom side flaps 92, footpedal 82 is momentarily depressed, actuating a limit valve (LV1) allowing air pass to valve V1 pilot through line 1. Valve V1 then shifts, allowing air to pass to port B of each rotary cylinder 74 through line 12. Cylinders 74 are thus actuated, causing doors 73 to swing to a generally horizontal position, and folding flaps 92 inwardly. Air flow controls FC1–FC4 adjust the speed of the door movement. Stops on doors 73 are adapted to stop folding action so that the inward edges of flaps 92 are spaced under the horizontal surface of support 38, to allow the carton to slide along support 38.

The carton is now ready to be loaded. The tilted position enables easy access to carton 90, and facilitates loading and stacking of flat materials within the carton. The absence of awkward protrusions from the rear and sidewalls of the device also facilitates access and loading.

Once it is loaded, the carton is ready to be discharged from the machine. Footpedal 83 is depressed to actuate limit valve LV2, allowing air to pass to valve V2 pilot through line 2. Valve V2 shifts, allowing air to pass to port B of each cylinder 81 through line 14. As cylinders 81 are actuated, rods 84 are extended, causing the hinge in support 80 to fold, and allowing rails 18 to return to a level position on stop 62 on the front of frame 33.

When rails 18 return to a level position, they activate limit valve 97 (LV3) allowing air to pass to one-shot valve OSl through line 3. [A one-shot valve is a valve which applies a momentary single air pulse when inlet pressure is applied. No additional flow is possible until inlet pressure has been removed and re-applied.]One shot valve OSl supplies a momentary pulse to V3 pilot, through line 4. When valve V3 shifts, air is allowed to pass to port A of cable-drive cylinder 66, through line 16. Cylinder 66 is actuated, moving the cable and driving the push bar forward to discharge the full carton onto conveyor 102.

When the push bar reaches the extended forward position, limit valve 105 LV4 is momentarily depressed, allowing air to pass through line 5 to valve V3 pilot. Valve V3 shifts allowing air to pass to port B of cylinder 66 through line 15. Cylinder 66 then retracts the push bar.

When the push bar reaches the retracted position, switch 105 activates limit valve (LV5), allowing air to pass to one-shot valve OS2, through line 6. One-shot valve OS2 then supplies a momentary single pulse to the pilots of valve V1 and valve V2, through line 7. Valve V1 shifts, allowing air to pass to port A of each rotary cylinder 74 via line 11, returning doors 73 to vertical. At the same time, valve V2 shifts allowing air to pass to port A of each cylinder 81 via line 13, causing rod 84 to retract, returning rails 18 to the inclined position.

The apparatus is thus ready to load another carton.

Other apparatus and methods are within the following claims.

I claim:

1. An erecting and holding device for a shipping carton having a pair of bottom end flaps and a pair of bottom side flaps, said device comprising a support structure for supporting a said, carton in an upright position with said bottom end flaps folded into a generally horizontal position and said side flaps unfolded and extending generally vertically downwardly, a pair of folding members, mounted below and on opposite sides of said support structure, each of said members comprising a surface attached to a first drive means, said first drive means being adapted to swing said folding-member surfaces from a vertical position to a substantially horizontal position, tilt means for moving said support structure between a first position in which a carton supported thereby is substantially horizontal and a second position in which a carton supported thereby is inclined with respect to the horizontal, and for supporting said support structure in said second position, said tilt means comprising a member connecting said support means to a horizontal member and said connecting member being hinged at a point which is connected to a reciprocating piston rod, whereby movement of said rod flexes said hinge, altering the effective length of said connecting member to change the height of said support means in the vertical plane through said point of connection between said support means and said member, discharge means for discharging a carton supported by said support structure from said support structure, said discharge means comprising a U-shaped engaging member to engage one end of, and to extend at least partially around the sides of, a said carton, and a second drive means communicating with said U-shaped member to move it between a first position in which it is positioned to engage one end of a said carton supported on said support structure, and a second position spaced generally horizontally from said first position whereby movement of said member from said first position to said second position will move a said carton off of said support structure and discharge it, said second drive means being mounted along one side of said device, and control means for activating selected ones of said first drive means, said second drive means, and said tilt means.

2. The device of claim 1 wherein said second drive means comprises a pneumatic cylinder and a cable driven by said cylinder, said cable being connected to said U-shaped member.

3. The device of claim 1 wherein said device comprises a rear wall and said second drive means is positioned entirely forward of said rear wall.

4. The device of claim 1 wherein said discharge means comprises a pair of spaced apart horizontal rails, said U-shaped member being supported by said rails and being slidably mounted thereon.

5. The device of claim 4 wherein said device comprises side walls and said rails are positioned entirely between said side walls.

6. The device of claim 4 wherein said device comprises a rear wall and said rails are positioned entirely forward of said rear wall.

7. The device of claim 1 wherein said support structure comprises a member extending longitudinally along the mid-line of said apparatus and comprising a horizontal surface to engage said folded end flaps and thereby support said carton.

8. The device of claim 1 wherein said control means comprises a switch means for activating said first drive means to move said folding-member surfaces from a vertical position to a horizontal position.

9. The device of claim 1 wherein said control means comprises a switch means for activating said tilt means to move said support structure from said inclined position to said horizontal position.

10. The device of claim 1 wherein said control means comprises a switch means for automatically activating said discharge means to move said U-shaped member from said first position to said second position when said support structure reaches said horizontal position.

11. The device of claim 1 wherein said control means comprises a switch means for automatically activating said second drive means to move said U-shaped member from said second position to said first position when said U-shaped member reaches said second position.

12. The device of claim 1 wherein said control means comprises a switch means for automatically activating said first drive means to move said flap-folding surfaces from said horizontal position to said vertical position when said U-shaped member returns to said first position.

13. The device of claim 1 wherein said control means comprises a switch means for automatically activating said tilt means to move said support structure from said horizontal position to said inclined position when said U-shaped member returns to said first position.

14. The device of claim 1 wherein said control means comprises a first switch means for activating said first drive means to move said folding-member surfaces from a vertical position to a horizontal position, a second switch means for activating said tilt means to move said support structure from said inclined position to said horizontal position, a third switch means for automatically activating said discharge means to move said U-shaped member from said first position to said second position when said support structure reaches said horizontal position, a fourth switch means for automatically activating said second drive means to move said U-shaped member from said second position to said first position when said U-shaped member reaches said second position, a fifth switch means for automatically activating said first drive means to move said flap-folding surfaces from said horizontal position to said vertical position when said U-shaped member returns to said first position, and a sixth switch means for automatically activating said tilt means to move said support structure from said horizontal postition to said inclined position when said U-shaped member returns to said first position.

15. An erecting and holding device for shipping carton said device comprising a pair of side walls and a rear wall extending between said side walls, a support structure for supporting a said carton in an upright position during loading, discharge means for discharging a filled carton from said device, said discharge means comprising a U-shaped engaging member to engage one end of, and extend at least partially around the sides of, a said carton, and a pair of horizontal spaced apart rails, said rails being positioned between said side walls and entirely forward of said rear wall, and said U-shaped member being slidably mounted on and supported by said rails, and a drive means communicating with said U-shaped member to move it between a first position on said rails in which it is positioned to engage one end of a said carton supported on said support structure, and a second position spaced generally horizontally from said first position whereby movement of said member from said first position to said second position will move a said carton off of said support structure and discharge it, said drive means being mounted along one said side wall, and positioned entirely forward of said rear wall.

16. The device of claim 15 wherein said drive means further comprises a pneumatic cylinder mounted along one said side wall.

17. The device of claim 16 wherein said drive means further comprises a cable driven by said cylinder, said cable being attached to said U-shaped member.

18. The device of claim 15 further comprising tilt means for moving said support structure between a first position in which a carton supported thereby is substantially horizontal and a second position in which a carton supported thereby is inclined with respect to the horizontal, and for supporting said frame in said inclined position.

19. The device of claim 18 wherein said tilt means comprises a member connecting said support structure to a horizontal member, and said connecting member is hinged at a point which is connected to a reciprocating piston rod, whereby movement of said rod flexes said hinge, altering the effective length of said connecting member to change the height of said support means in the vertical plane through said point of connection between said support structure and said member.

* * * * *